US006185388B1

(12) United States Patent
Yamamoto

(10) Patent No.: US 6,185,388 B1
(45) Date of Patent: Feb. 6, 2001

(54) IMAGE HEATING APPARATUS WITH STANDBY TEMPERATURE OVERSHOOTING PREVENTION FEATURE

(75) Inventor: Naoyuki Yamamoto, Shizuoka-ken (JP)

(73) Assignee: Canon Kabushiki Kaisha, Tokyo (JP)

( * ) Notice: Under 35 U.S.C. 154(b), the term of this patent shall be extended for 0 days.

(21) Appl. No.: 09/253,515

(22) Filed: Feb. 22, 1999

(30) Foreign Application Priority Data

Feb. 27, 1998 (JP) ..... 10-064316

(51) Int. Cl.[7] ..... G03G 15/20; H05B 1/00

(52) U.S. Cl. ..... 399/69; 219/216; 399/70; 399/328

(58) Field of Search ..... 219/216; 399/67, 399/68, 69, 320, 328, 331, 70, 324, 330

(56) References Cited

U.S. PATENT DOCUMENTS 5,708,920 * 1/1998 Ohnishi et al. ..... 399/69

* cited by examiner

*Primary Examiner*—Arthur T. Grimley
*Assistant Examiner*—Hoang Ngo
(74) *Attorney, Agent, or Firm*—Fitzpatrick, Cella, Harper & Scinto

(57) ABSTRACT

An image heating apparatus includes a power supply controller, which sets the set temperature to change the temperature of the heating roller. The power supply is cut off before the temperature of the heating roller reaches the set temperature. A predetermined time later, the heating roller and the back-up roller stop rotating.

8 Claims, 7 Drawing Sheets

IMAGE HEATING APPARATUS WITH STANDBY TEMPERATURE OVERSHOOTING PREVENTION FEATURE

BACKGROUND OF THE INVENTION

1. Field of the Invention

This invention relates to an image heating apparatus for use in an image forming apparatus such as a copying apparatus or a printer, and particularly to an image heating apparatus for sandwiching a recording material carrying an image thereon between a pair of rollers and conveying it and heating the image.

2. Related Background Art

An image heating apparatus, for example, a fixing apparatus, used in an image forming apparatus has merits such as a short warming-up time, a small space and cost saving, and is used in a copying apparatus, a printer or the like.

In the construction of such a fixing apparatus, however, fixation is effected at a relatively high temperature, and this leads to the problem that in a system using a fixing roller (fixing rotatable member) using silicone rubber or fluorine rubber as an elastic layer, the rubber is deteriorated by the high temperature.

Also, there occurs so-called overshooting in which when a set temperature is reached after the closing of a power source switch or immediately after the completion of the copying operation, the roller is excessively heated by the time lag until heat is transferred from heating means to the surface of the roller. By this phenomenon as well, the elastic layer of the fixing roller is deteriorated.

Also, if the fixing operation is performed at a temperature higher than necessary, there is caused so-called high temperature offset which causes a toner to adhere to the fixing roller to thereby cause a bad image.

As means for suppressing overshooting, there has heretofore been proposed a method of stopping power supply to heating by conjecturing the time from the rise of the temperature of the fixing roller till the completion of warming up at the starting time of the image forming apparatus, or stopping power supply to a heating source by the temperature of the fixing roller reaching a predetermined temperature lower than the temperature at the completion of warming up, or decreasing the amount of heat imparted from the heating source to the fixing roller more than immediately after the closing of the power source switch when the temperature of the fixing roller reaches a predetermined temperature lower than the temperature at the completion of warming up.

In any of the above-described methods, however, the warming-up time is not sufficiently short.

Also, in a fixing device having a heating source only on the fixing roller side, the temperature of a pressing roller is needed to be made as high as possible to secure fixativeness, and has a great influence on fixativeness particularly in copying immediately after starting.

On the other hand, as means for suppressing the overshooting immediately after the copying operation, there have been proposed a method in which during continuous copying, power supply to the heating source is cut off depending on a predetermined number of sheets, and a method of decreasing the amount of heat imparted to the fixing roller more than at the start of continuous copying.

In the fixing device having a heating source only on the fixing roller side, however, there arises the problem that the temperature of the pressing roller drops and in the next copying operation, low temperature offset occurs.

SUMMARY OF THE INVENTION

The present invention has been made in view of the above-noted problem and an object thereof is to provide an image heating apparatus in which the overshooting of a heating roller during the power supply to a heater is suppressed.

Another object of the present invention is to provide an image heating apparatus having a heater, a heating roller heated by the heater, a back-up roller cooperating with the heating roller to form a nip for holding and conveying a recording material, and power supply control means for controlling the power supply to said heater so that the temperature of said heating roller may maintain a set temperature and wherein when said power supply control means sets the set temperature and changes the temperature of said heating roller, the power supply is cut off before the temperature of said heating roller reaches the set temperature, and a predetermined time later, said heating roller and said back-up roller stop their rotation.

Still another object of the present invention is to provide an image heating apparatus having a heater, a heating roller heated by the heater, a back-up roller cooperating with said heating roller to form a nip for holding and conveying a recording material, power supply control means for controlling the power supply to said heater so that the temperature of said heating roller may maintain a set temperature, and rotation control means for controlling the rotation of said heating roller and said back-up roller in conformity with the temperature of said back-up roller when the temperature of said heating roller is maintained at the set temperature.

Further objects of the present invention will become apparent from the following detailed description taken in conjunction with the accompanying drawings.

DESCRIPTION OF THE PREFERRED EMBODIMENTS

Some embodiments of the present invention will hereinafter be described with reference to the drawings.

Figure 1:
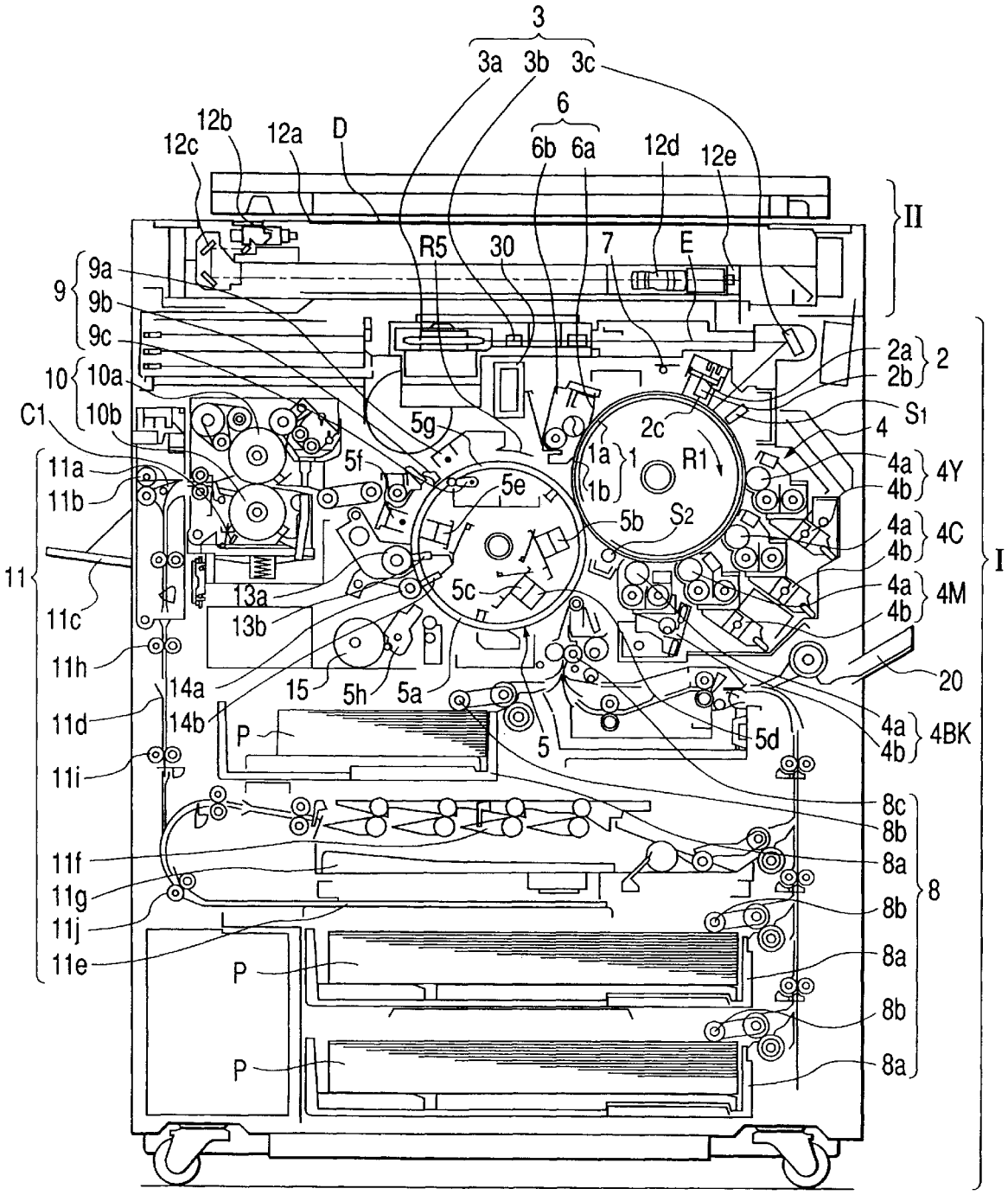
FIG. 1 is a cross-sectional view schematically showing the construction of an image forming apparatus according to an embodiment of the present invention.

FIG. 1 is a cross-sectional view schematically showing the construction of a four-full-color image forming apparatus of the digital type common to the following embodiments as an example of an image forming apparatus using the image heating apparatus of the present invention.

The image forming apparatus shown in FIG. 1 is provided with a digital color image printer portion (hereinafter simply referred to as the "printer portion") I as image forming means in the lower portion, and a digital color image reader portion (hereinafter simply referred to as the "reader portion") II, and forms an image on a recording material P by the printer portion I on the basis, for example, of the image information of an original D read by the reader portion II.

The construction of the printer portion I, and then the construction of the reader portion II will hereinafter be described briefly.

The printer portion I has a photosensitive drum 1 which is an image bearing member rotatively driven in the direction of arrow R1. A primary charger (charging means) 2, exposure means 3, a developing device (developing means) 4, a transfer device 5, a cleaning device 6, a pre-exposure lamp 7, etc. are disposed in the named order around the photosensitive drum 1 along the direction of rotation thereof. A paper supply conveying portion 8 for the recording material P is disposed below the transfer device 5, i.e., in the lower half of the printer portion I, and further, separating means 9 is disposed in the upper portion of the transfer device 5, and a fixing device 10 and a paper discharging portion 11 are disposed downstream of the separating means 9 (downstream with respect to the direction of conveyance of the recording material P).

The photosensitive drum 1 has a drum-shaped base member 1*b* made of aluminum, and a photosensitive member 1*a* of OPC (organic photo (optical) semiconductor) covering the surface thereof, and is designed to be rotatively driven at a predetermined process speed (peripheral velocity) in the direction of arrow R1 by driving means (not shown). The photosensitive drum 1 will be described later in greater detail.

The primary charger 2 is a corona charger having a shield 2*a* opening at a portion opposed to the photosensitive drum 1, a discharge wire 2*b* disposed inside the shield 2*a* in parallel with to the bus line of the photosensitive drum 1, and a grid 2*c* disposed in the opening portion of the shield 2*a* for regulating a charging potential. The primary charger 2 has a charging bias applied thereto by a power source (not shown), thereby uniformly charging the surface of the photosensitive drum 1 to a predetermined polarity and predetermined potential.

The exposure means 3 has a laser outputting portion (not shown) emitting a laser beam on the basis of an image signal from the reader portion II which will be described later, a polygon mirror 3*a* for reflecting the laser beam, a lens 3*b* and a mirror 3*c*. The exposure means 3 is designed such that this laser beam irradiates the surface of the photosensitive drum 1 to thereby expose the photosensitive drum 1, and removes the charges in the exposed portion and forms an electrostatic latent image. In the present embodiment, the electrostatic latent image formed on the surface of the photosensitive drum 1 may be color-resolved into four colors, i.e., yellow, cyan, magenta and black, on the basis of the image of the original, and electrostatic latent images corresponding to the respective colors may be successively formed.

The developing device 4 is provided with four developing devices in succession from the upstream side along the direction of rotation of the photosensitive drum 1 (the direction of arrow R1), i.e., developing devices 4Y, 4C, 4M and 4Bk containing therein yellow, cyan, magenta and black toners (developers) each having resin as a base material. Each of the developing devices 4Y, 4C, 4M and 4Bk has a developing sleeve 4*a* for causing the toner to adhere to the electrostatic latent image formed on the surface of the photosensitive drum 1, and a developing device of a predetermined color may be selectively disposed at a developing position proximate to the surface of the photosensitive drum 1, and may cause the toner to adhere to the electrostatic latent image through the developing sleeve 4*a* to thereby form a toner image (visible image) as a visualized image. The other developing devices of three colors than the developing device used for development are adapted to be retracted from the developing position.

The transfer device 5 has a transfer drum (recording material carrying member) 5*a* carrying the recording material P on the surface thereof, a transfer charger 5*b* for transferring the toner images on the photosensitive drum 1 to the recording material P, an adsorbing charger 5*c* for adsorbing the recording material P to the transfer drum 5*a*, an adsorbing roller 5*d* opposed thereto, an inner charger 5*e* and an outer charger 5*f*. A recording material carrying sheet 5*g* formed of a dielectric material is cylindrically extended in the peripheral opening area of the transfer drum 5*a* journalled so as to be rotatively driven in the direction of arrow R5. As the recording material carrying sheet 5*g*, use is made of a sheet of a dielectric material such as polycarbonate film. The transfer device 5 is designed such that the recording material P is sucked to and carried on the surface of the transfer drum 5*a*.

The cleaning device 6 is provided with a cleaning blade 6*a* for scraping off any residual toner which was not transferred to the recording material P but remains on the surface of the photosensitive drum 1, and a cleaning container 6*b* for collecting the thus scraped-off toner.

The pre-exposure lamp 7 is disposed adjacent to the upstream side of the primary charger 2 and removes unnecessary charges on the surface of the photosensitive drum 1 cleaned by the cleaning device 6.

The paper supply conveying portion 8 has a plurality of paper supply cassettes 8*a* containing therein recording materials P of different sizes, paper feeding rollers 8*b* for feeding the recording materials P in the paper supply cassettes 8*a*, a number of conveying rollers, and registration rollers 8*c*, and supplies recording materials P of a selected size to the transfer drum 5*a*.

The separating means 9 has a separating charger 9*a* for separating the recording material P after the transfer of the toner images thereto from the transfer drum 5*a*, a separating pawl 9*b* and a separating push-up roller 9*c*.

The fixing device 10 has a fixing roller 10*a* having a heater therein, and a pressing roller (back-up roller) 10*b* disposed below the fixing roller (heating roller) 10*a* for urging the recording material P against the fixing roller 10*a*.

The paper discharging portion 11 has a conveying path changeover guide 11*a* disposed downstream of the fixing device 10, discharge rollers 11*b*, a paper discharge tray 11*c*, etc. Also, below the conveying path changeover guide 11*a*, there are disposed a conveying vertical path 11*d*, a reversing path 11*e*, a supporting member 11*f*, an intermediate tray 11*g*, conveying rollers 11*h*, 11*i*, and reversing rollers 11*j* for effecting image formation on the both surfaces of a recording material P.

Also, a potential sensor S1 for detecting the charging potential of the surface of the photosensitive drum is disposed between the primary charger 2 and the developing device 4 around the photosensitive drum 1, and a density sensor S2 for detecting the density of the toner images on the photosensitive drum 1 is disposed between the developing device 4 and the transfer drum 5*a*.

The reader portion II will now be described. The reader portion II disposed above the printer portion I has original supporting table glass 12*a* for supporting the original D thereon, an exposure lamp 12*b* for exposing and scanning the image surface of the original D while moving, a plurality of mirrors 12*c* for further reflecting the reflected light from the original D, a lens 12*d* for condensing the reflected light, and a full color sensor 12*e* for forming a color resolving image signal on the basis of the light from the lens 12*d*. The color separation image signal may be processed by a video processing unit (not shown) via an amplifying circuit (not shown), and be delivered to the above-described printer portion I.

The operation of the image forming apparatus of the above-described construction will now be described briefly with some constructions added thereto. In the following description, it is to be understood that four full color images are formed in the order of yellow, cyan, magenta and black.

The image of the original D placed on the original supporting table glass 12*a* of the reader portion II is irradiated by the exposure lamp 12*b* and is color-resolved, and first the yellow image is read by the full color sensor 12*e*, and is subjected to predetermined processing and sent to the printer portion I.

In the printer portion I, the photosensitive drum 1 is rotatively driven in the direction of arrow R1, and the surface thereof is uniformly charged by the primary charger 2. On the basis of an image signal sent from the above-described reader portion II, a laser beam is emitted from the laser outputting portion of the exposure means 3, and the surface of the charged photosensitive drum 1 is exposed by an optical image E through the intermediary of the polygon mirror 3*a*, etc. Charges are removed from that portion of the surface of the photosensitive drum 1 which has been exposed, whereby an electrostatic image corresponding to yellow is formed. In the developing device 4, the yellow developing device 4Y is disposed at a predetermined developing position, and the other developing devices 4C, 4M and 4Bk are retracted from the developing position. Yellow toner is adhered to the electrostatic latent image on the photosensitive drum 1 by the developing device 4Y, and the electrostatic latent image is visualized into a toner image. This yellow toner image on the photosensitive drum 1 is transferred to the recording material P carried (born) on the transfer drum 5*a*. The recording material P has been supplied to the transfer drum 5*a* at predetermined timing from the paper supply cassette 8*a* through the paper feeding roller 8*b*, the conveying roller and the registration rollers 8*c*. The recording material P thus supplied is sucked to the surface of the transfer drum 5*a* in such a manner as to wrap around it and is rotated in the direction of arrow R5, and the yellow toner image on the photosensitive drum 1 is transferred thereto by the transfer charger 5*b*.

On the other hand, the photosensitive drum 1 after the transfer of the toner image has any residual toner on its surface removed by the cleaning device 6 and further, has its unnecessary charges removed by the pre-exposure lamp 7, and is used for the next cycle of image formation beginning from the primary charger.

The above-described processes from the reading of the image of the original by the reader portion II to the transfer of the toner image on the transfer drum 5*a* to the recording material P and further the cleaning and charge removal of the photosensitive drum 1 are likewise effected with respect to the other colors than yellow, i.e., cyan, magenta and black, and toner images of four colors are superposedly transferred to the recording material P on the transfer drum 5*a*.

The recording material P to which the toner images of four colors have been transferred is separated from the transfer drum 5*a* by the separating pawl 9*b*, etc. and is conveyed to the fixing device 10 with the unfixed toner images carried on its surface. The recording material P is heated and pressed by the fixing roller (fixing rotatable member) 10*a* and pressing roller (pressing rotatable member) 10*b* of the fixing device 10 as fixing means, and the toner images on the surface thereof are melted and fixed. After the fixing, the recording material P is discharged onto the paper discharge tray 11*c* by the discharge rollers 11*b*. When images are to be formed on the both surfaces of the recording material P, the fixing device 10 once directs the recording material P after discharged to the reversing path 11*e* via the conveying vertical path 11*d* by immediately driving the conveying path changeover glass 11*a*, whereafter the recording material P is moved in the direction opposite to the direction in which it has been fed in with its trailing end when fed in by the reverse rotation of the reversing rollers 11*j* as the leading end, and is received into the intermediate tray 11*g*. Thereafter, again by the above-described image forming processes, an image is formed on the other surface of the recording material P, whereafter the recording material P is discharged onto the paper discharge tray 11*c*.

On the transfer drum 5*a* after the separation of the recording material P, cleaning is effected by a fur brush 13*a* and a back-up brush 13*b*, and an oil removing roller 14*a* and a back-up brush 14*b* opposed to each other with the recording material carrying sheet 5*g* interposed therebetween, in order to prevent the scattering and adherence of the powder material onto the recording material carrying sheet 5*g* and the adherence of oil onto the recording material P. Such cleaning is effected before or after image formation, and is effected at any time when jam (paper clogging) occurs.

The fixing device 10 will now be described with reference to FIG. 2.

Figure 2:
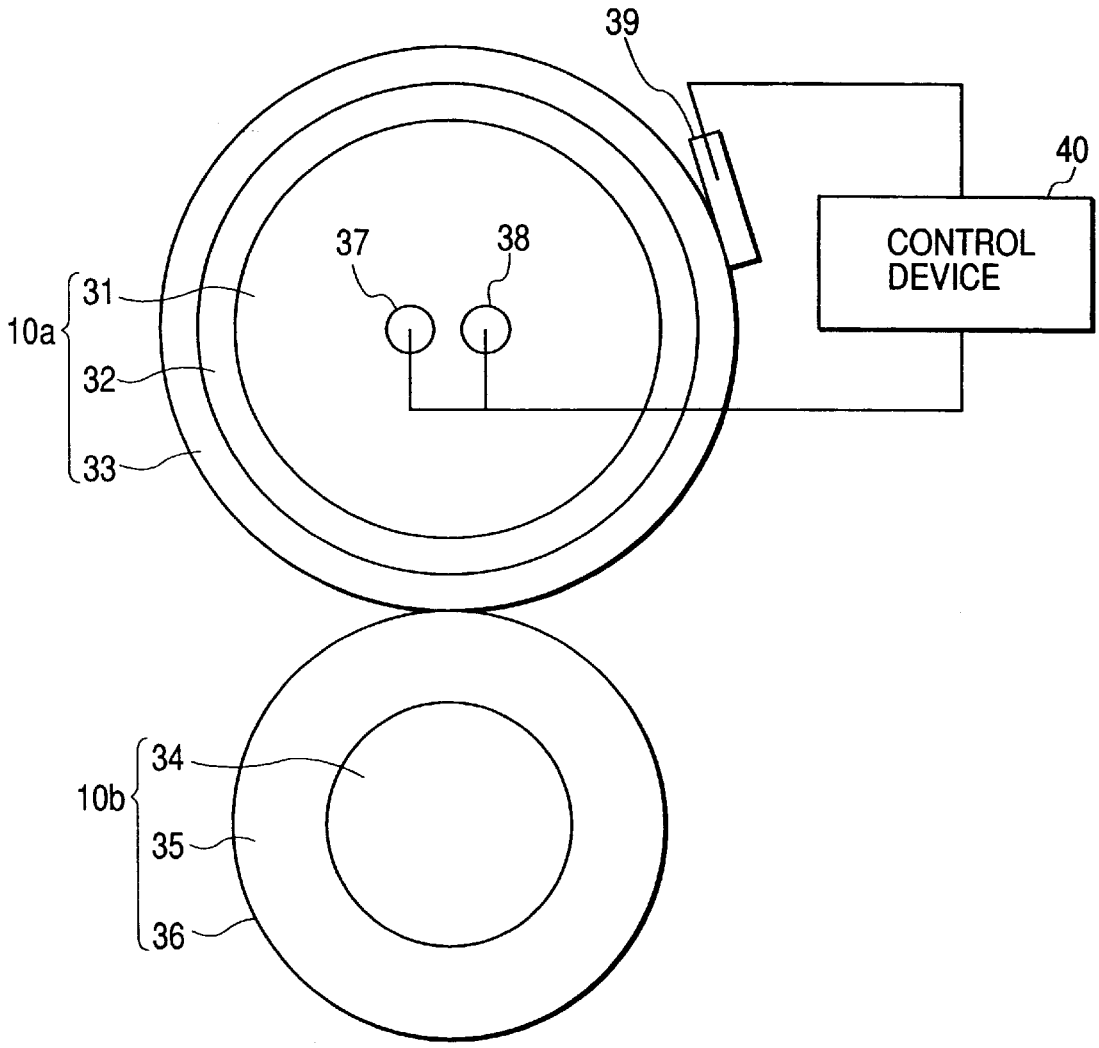
FIG. 2 shows a fixing device according to an embodiment of the present invention.

In FIG. 2, the fixing roller 10*a* for contacting with the toner image has, on a hollow mandrel 31 made of iron and having a thickness of 0.7 mm, a silicone rubber layer 32 having a thickness of 1.2 mm, and a PFA (tetrafluoroethylene-perfluoroalkyl vinyl ether copolymer) tube layer 33 having thickness of 50 $\mu$m provided outside of the silicone rubber layer, and is formed to a diameter of 40 mm.

On the other hand, the pressing roller 10*b* has, on a solid mandrel 34 made of iron, a silicone rubber layer 35 having a thickness of 5 mm, and further a PFA tube layer 36 having a thickness of 50 $\mu$m, and is formed to a diameter of 30 mm.

The above-described fixing roller 10*a* has halogen heaters 37 and 38 which are heating means disposed in the mandrel 31. The temperature of the fixing roller 10*a* is detected by a thermistor (fixing rotatable member temperature detecting means) 39 bearing against the fixing roller 10*a*, and on the basis of this detected temperature, the halogen heaters 37 and 38 are controlled by a control device (temperature control means) 40, whereby the temperature of the fixing roller 10*a* is controlled so as to be maintained constant. The fixing roller 10*a* and the pressing roller 10*b* are pressed against each other with total pressure of about 30 kg by a pressing mechanism (not shown). During the fixation of the recording material P, the fixing roller 10*a* and the pressing roller 10*b* are rotated at a process speed of 100 mm/sec. by a motor (rotatable member driving means), not shown.

In the above-described fixing device 10, the recording material P carrying the unfixed toner image on its surface is sandwiched or nipped and conveyed by the fixing nip between the fixing roller 10*a* and the pressing roller 10*b*, and at this time, it is pressed and heated, whereby the fixation of the toner is effected.

(First Embodiment)

This first embodiment uses the apparatus of the above-described construction and relates to the temperature control and roller pair rotation sequence during the closing of a power source switch.

Figure 3:
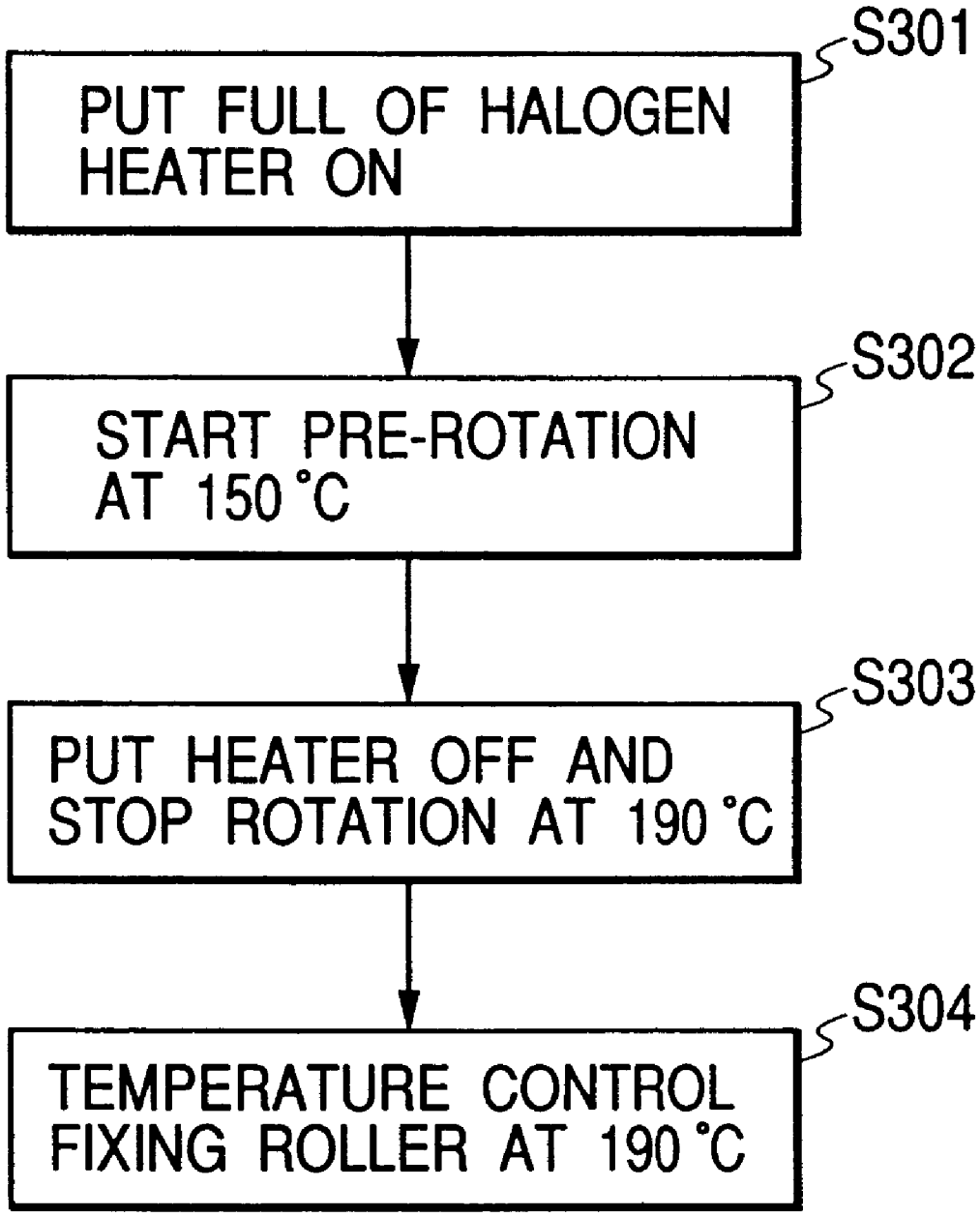
FIG. 3 is a flowchart showing the temperature control and roller pair rotation sequence of a fixing device according to a comparative example.

First, the flowchart of FIG. 3 shows a comparative example of the temperature control and roller pair rotation sequence. Immediately after the closing of the power source switch, the halogen heaters 37 and 38 are turned on with maximum electric power (S301). Thereafter, when the thermistor 39 detects 150° C., the rotation of the fixing roller 10*a* and the pressing roller 10*b* is started (S302). Thereafter, when the thermistor 39 detects 190° C., the halogen heaters 37 and 38 are turned off and at the same time, the rotation of the pair of rollers is stopped, and the rising is completed (S303). Thereafter, the halogen heaters 37 and 38 repeat turn-on-and-off by the control device 40 so that the surface of the fixing roller 10*a* may be maintained at 190° C. (S304).

In the case of this comparative example 1, the surface temperature of the fixing roller 10*a* reached 230° C. at maximum by overshooting.

Figure 4:
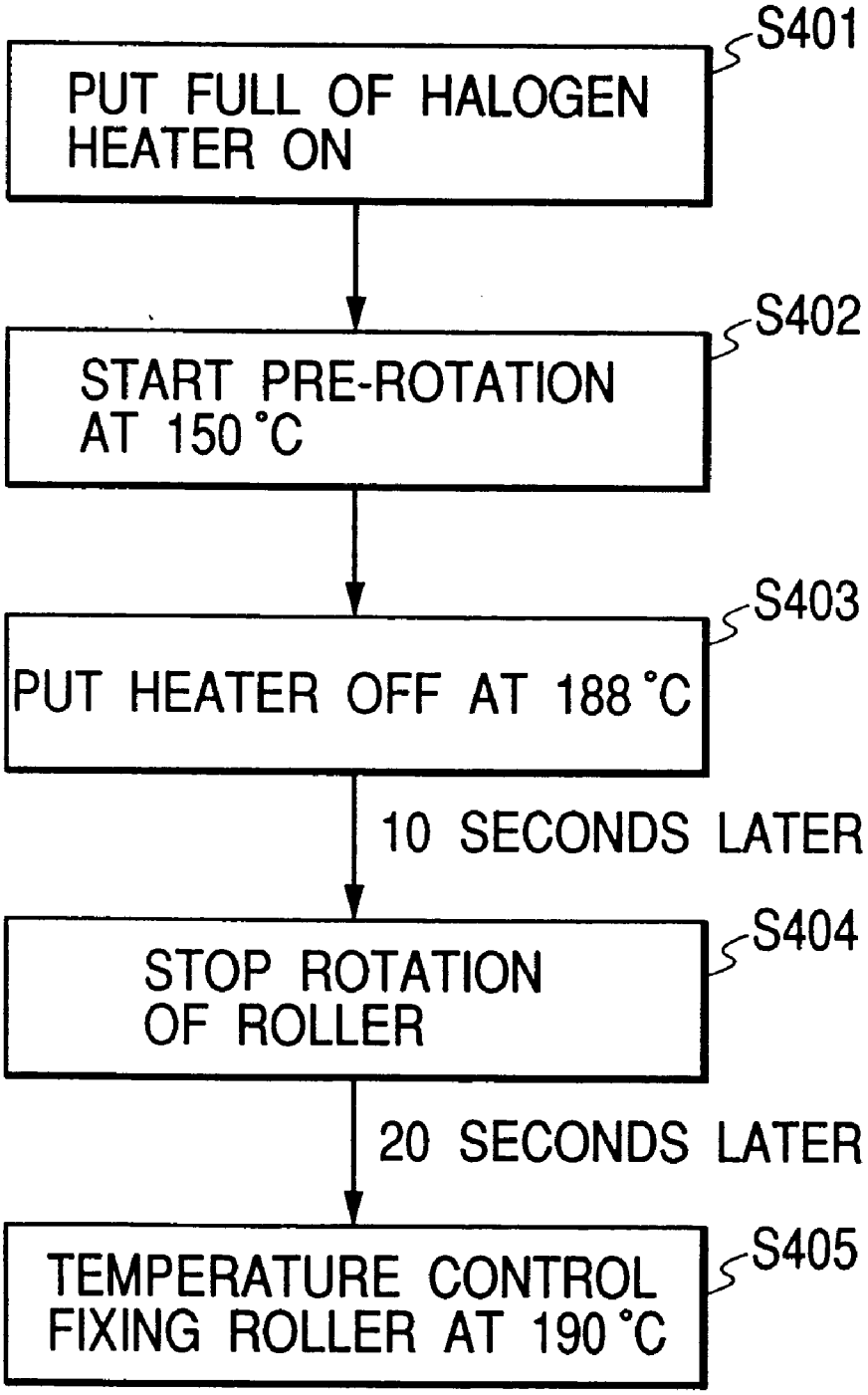
FIG. 4 is a flowchart showing the temperature control and roller pair rotation sequence of a fixing device according to a first embodiment of the present invention.

Next, in the present first embodiment, the temperature control and roller pair rotation sequence are effected as shown in the flowchart of FIG. 4.

First, immediately after the closing of the power source switch, the halogen heaters 37 and 38 are turned on with maximum electric power (S401). Thereafter, when the thermistor 39 detects 150° C. (pre-rotation starting temperature $T_1$), the rotation of the fixing roller 10*a* and the pressing roller 10*b* is started (S402). Thereafter, when the thermistor 39 detects 188° C. (control temperature $T_2$), the halogen heaters 37 and 38 are turned off (S403). At this point of time, the rising is completed. Ten seconds ($t_1$) after the halogen heaters have been turned off, the rotation of the pair of rollers is stopped (S404). Twenty seconds ($t_2$) after the rotation of the pair of rollers has been stopped, the halogen heaters 37 and 38 repeat turn-on-and-off so that the surface of the fixing roller 10*a* may be maintained at 190° C. (control temperature during standby) by the control device 40 (S405).

In the case of the present first embodiment, overshooting was little and the surface temperature of the fixing roller 10*a* was 195° C. at maximum.

As described above, in the present first embodiment, the overshooting after the closing of the power source switch can be suppressed to a low level, and this is effective against the deterioration of the rubber of the fixing roller, and bad fixation such as high temperature offset can also be suppressed.

The overshooting is greatly changed by the construction of the fixing device and the atmospheric temperature. In the present first embodiment, however, the time from the heaters are turned off until the rotation of the pair of rollers is stopped and the time after the rotation of the pair of rollers has been stopped until the temperature control is entered are optimized for the construction of the fixing device and the result of the detection by the environmental sensor for detecting the atmospheric temperature, whereby it becomes possible to suppress the overshooting to a low level.

(Second Embodiment)

This second embodiment relates to the temperature control and roller pair rotation sequence during the copying operation as image formation in the construction of the above-described embodiment.

Figure 5:
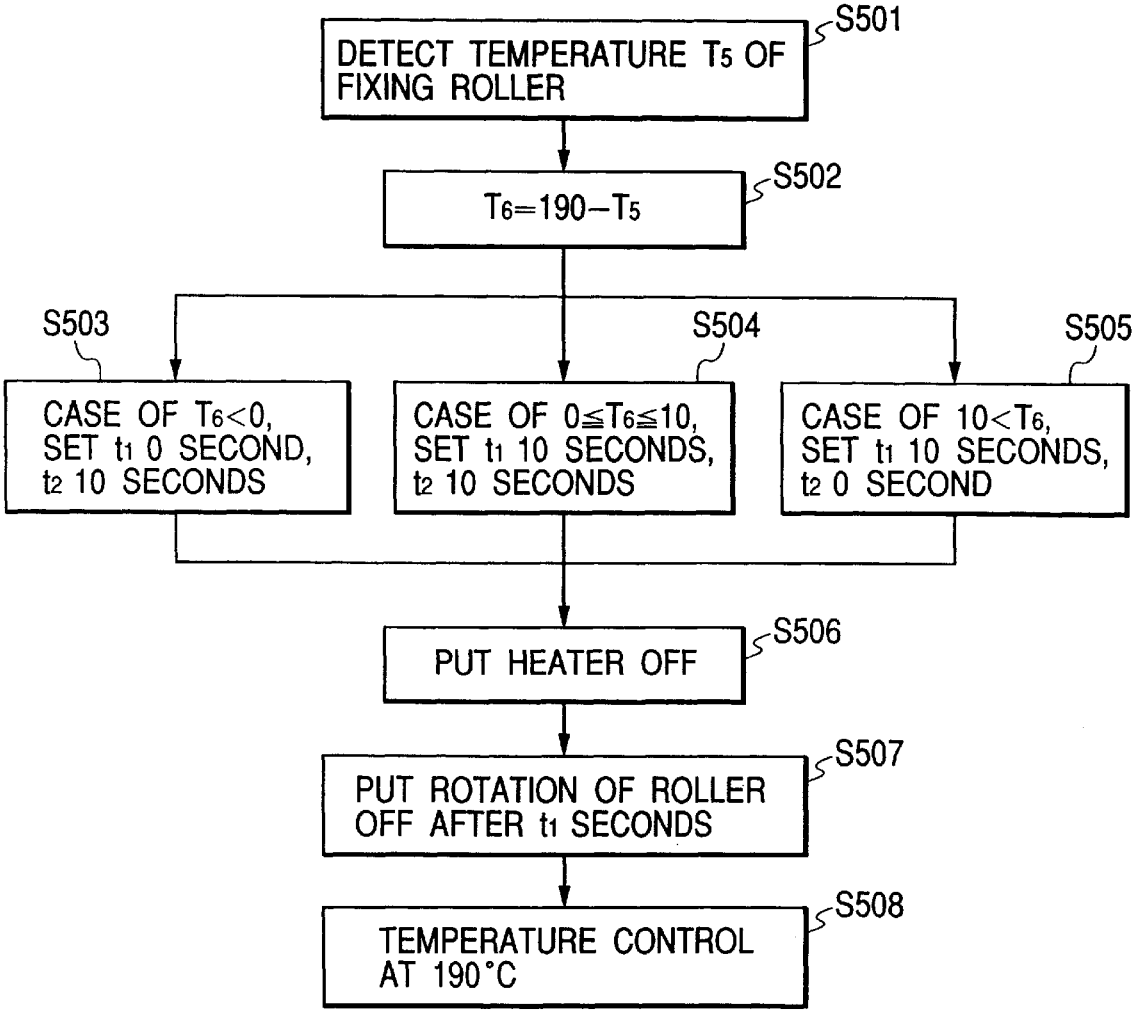
FIG. 5 is a flowchart showing the temperature control and roller pair rotation sequence of a fixing device according to a second embodiment of the present invention.

In the present second embodiment, the temperature control and roller pair rotation sequence are effected as shown in the flow chart of FIG. 5. First, during one cycle of copying operation, the temperature $T_5$ of the fixing roller immediately after the last recording material has passed the fixing device is detected (S501). Thereafter, the difference $T_6$ between the control temperature during standby (set temperature) (190° C. in the present embodiment) and $T_5$ is determined (S502). On the basis of the value of $T_6$ obtained at S502, a time $t_1$ and a time $t_2$ are determined (S503 to S506). The time $t_1$ after the heaters have been turned off, the rotation of the pair of rollers is stopped (S507). The time $t_2$ after the rotation of the pair of rollers has been stopped, temperature control is effected at the control temperature during standby, thus completing the copying operation.

In this case, the overshooting after the completion of the copying operation was suppressed to a low level, and the maximum value of the temperature of the fixing roller was 193° C.

Also, when as comparative example 2, the sequence as in the present embodiment was not used and during the copying operation, the surface temperature of the fixing roller was maintained at 190° C. irrespective of standby, the maximum value of the temperature of the fixing roller after the completion of the copying operation was 205° C.

As described above, in the present second embodiment, the overshooting after the completion of the copying operation can be suppressed to a low level, and this is effective against the deterioration of the rubber of the fixing roller, and bad fixation such as high temperature offset can also be suppressed.

Also, as in the first embodiment, in the present second embodiment, $t_1$ and $t_2$ are optimized for the construction of the fixing device, the result of the detection by the environmental sensor for detecting the atmospheric temperature, the kind of the recording material, etc., whereby it becomes possible to suppress overshooting to a lower level.

Also, in the present second embodiment, the temperature of the fixing roller immediately after the last recording material during one cycle of copying operation has passed the fixing device is measured, but also by judging the turn-on and turn-off of the halogen heaters immediately after the last recording material has passed the fixing device, an effect substantially similar to that of the second embodiment can be obtained.

Further, in an image forming apparatus using the present embodiment, when the bad conveyance of the recording material is detected at any other place than downstream of the fixing device with respect to the direction of passage of the recording material, the rotation of the fixing roller and the pressing roller is stopped after a recording material downstream of the recording material left in the apparatus after the turn-off of the halogen heaters which has caused the bad conveyance is discharged out of the apparatus through the fixing device, whereby the overshooting during bad conveyance can be suppressed to a low level.

(Third Embodiment)

This third embodiment relates to the temperature control and roller pair rotation sequence during standby.

When as in the construction of the present embodiment, the heating source is not present on the pressing roller side, the surface temperature of the pressing roller has a great influence upon fixativeness and quality of image and therefore, during standby, it is desirable for the pair of rollers to effect idle rotation to heat the pressing roller. Also, when wear of the surfaces of the rollers and the frictional damage by the thermistor, the paper discharging pawl or the like bearing against the roller are taken into account, it is desirable to reduce the number of revolutions of the roller.

Figure 6:
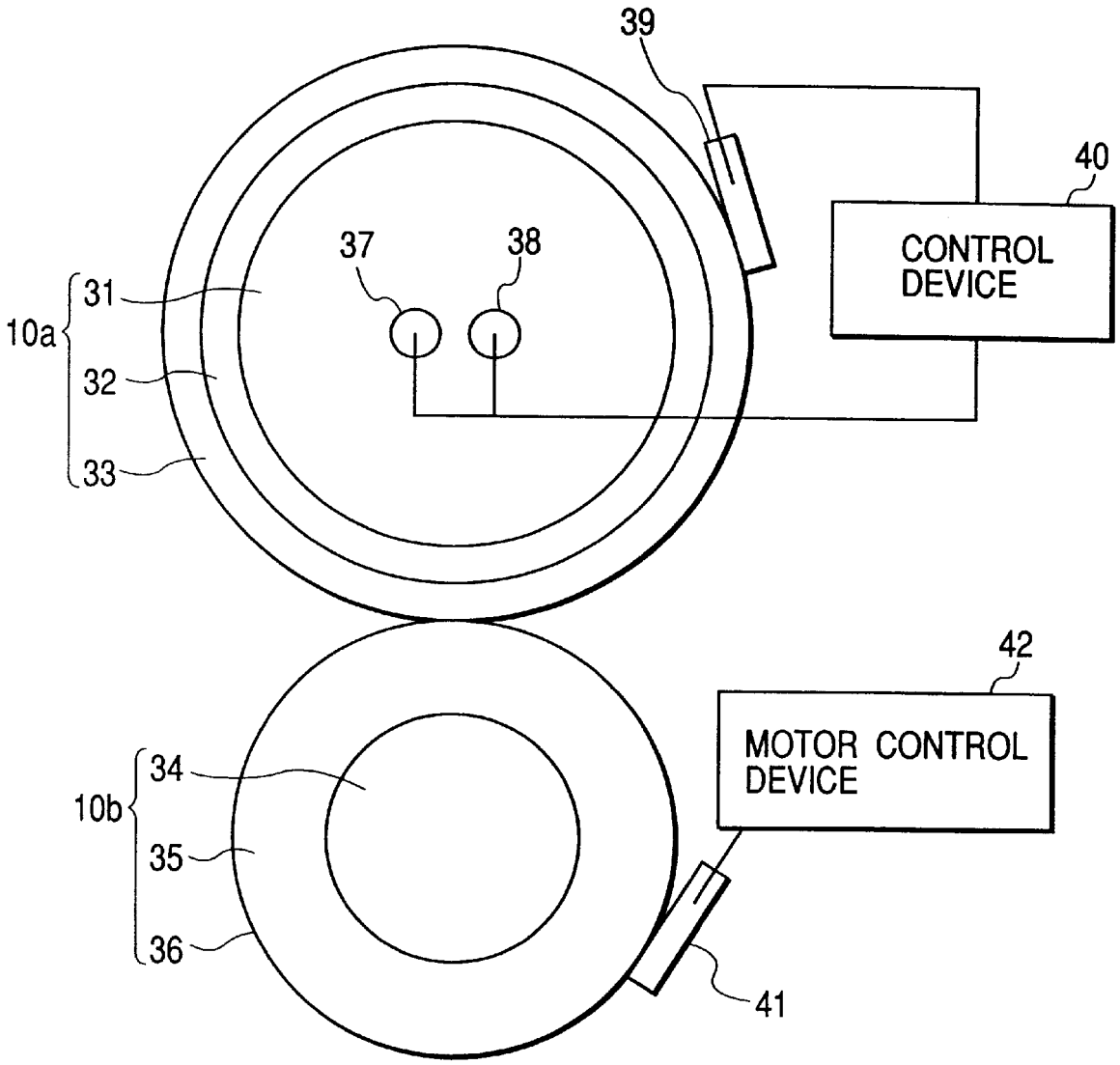
FIG. 6 shows a fixing device according to a third embodiment of the present invention.

The construction of a fixing device used in the present third embodiment is shown in FIG. 6. This construction is one in which pressing roller temperature detecting means (pressing rotatable member temperature detecting means) 41 and motor control means 42 are added to the fixing device used in the first embodiment and the second embodiment.

Figure 7:
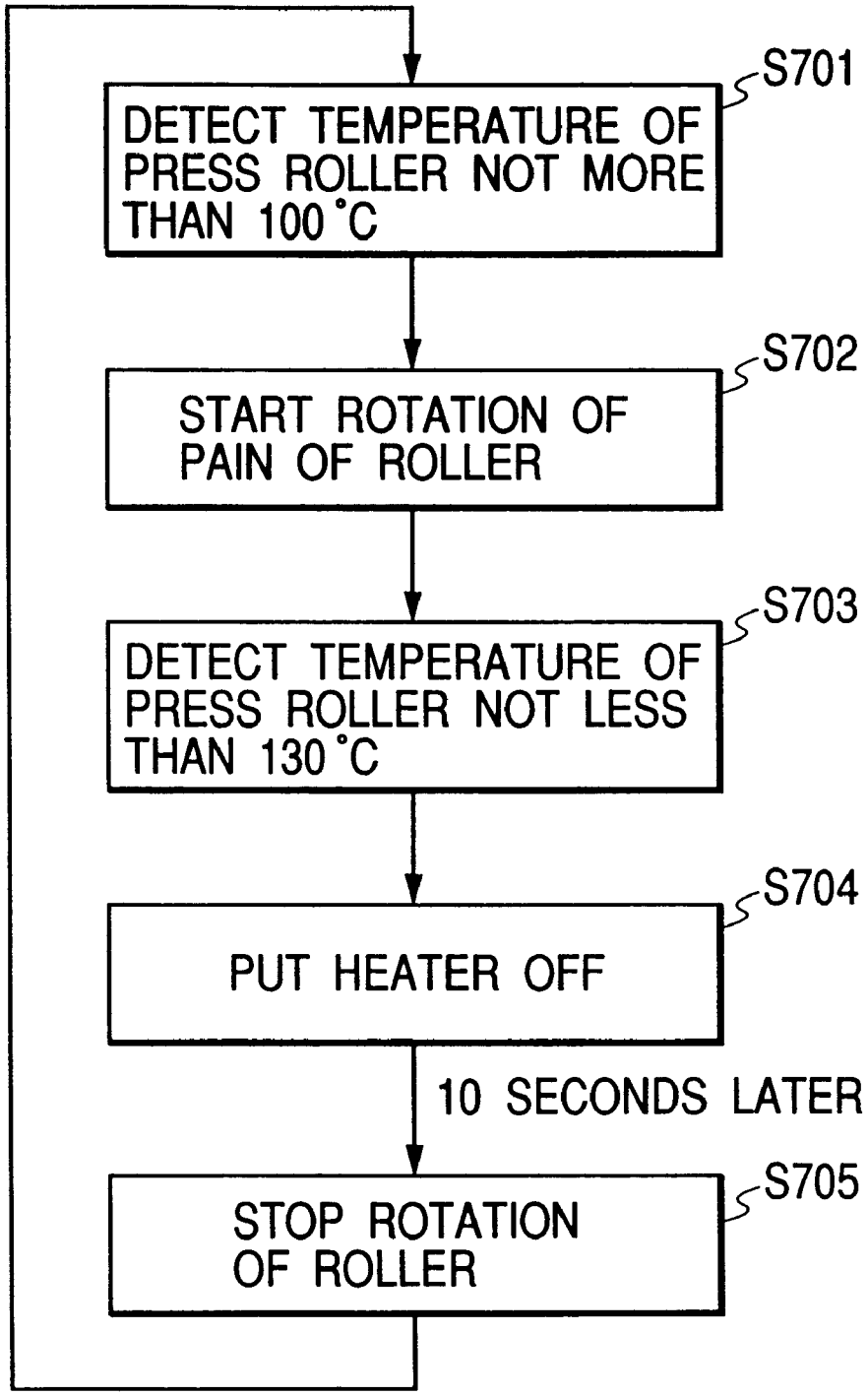
FIG. 7 is a flowchart showing the temperature control and roller pair rotation sequence of the fixing device according to the third embodiment of the present invention.

The temperature control and roller pair rotation sequence in the present third embodiment will now be described with reference to the flow chart of FIG. 7.

First, during standby, the halogen heaters 37 and 38 repeat turn-on-and-off so that the surface temperature of the fixing roller may be maintained at 190° C. When the pressing roller temperature detecting means 41 detects 100° C. (pressing rotatable member starting temperature $T_{71}$) or lower (S701), the pair of rollers are rotated by the motor control means 42 (S702). With the frictional damage or the like by the thermistor or the paper discharging pawl or the like taken into account, the rotational speed of the pair of rollers is 25 mm/sec. which is ¼ of the rotational speed during ordinary copying. Next, when the pressing roller temperature detecting means 41 detects 130° C. (pressing rotatable member rotation stoppage temperature $T_{72}$) or higher (S703), the halogen heaters are forcibly turned off at that moment (S704). 10 seconds after the heaters have been turned off, the rotation of the pair of rollers is stopped (S705). Thereafter, return is made to S701.

In this case, the overshooting of the fixing roller after the stoppage of the rotation of the pair of rollers was 192° C. at highest.

In contrast, when as comparative example 3, the heaters were not forcibly turned off and the rotation of the pair of rollers was stopped, the overshooting was great and the temperature of the fixing roller reached 201° C. at highest.

As described above, in the present third embodiment, the overshooting during the intermittent rotation of the pair of rollers during standby can be suppressed to a low level, and this is effective against the deterioration of the rubber of the fixing roller, and bad fixation such as high temperature offset can also be suppressed.

Also, as in the first and second embodiments, again in the present third embodiment, the time from after the heaters are turned off until the rotation of the pair of rollers is stopped is optimized for the construction of the fixing device and the result of the detection by the environmental sensor for detecting the atmospheric temperature, whereby it becomes possible to suppress the overshooting to a low level.

While in the present third embodiment, the rotation and stoppage of the pair of rollers are effected depending on the temperature of the pressing roller, it is also possible to control the rotation and stoppage depending on time, for example, continuing the rotation for two minutes, and thereafter stopping the rotation for two minutes, without detecting the temperature of the pressing roller.

By using the above-described image forming apparatus, the occurrence of overshooting is suppressed and the temperature of the fixing rotatable member is maintained at a predetermined temperature and therefore, the durability of the fixing rotatable member is improved and the service life thereof is lengthened, and the occurrence of bad fixation such as high temperature offset is suppressed and good image formation becomes possible. Also, the warming up time during starting is not sacrificed. Further, an amount of heat is also given to the pressing rotatable member and a fixing construction excellent in low temperature fixativeness can be provided.

The present invention is not restricted to the above-described embodiments, but covers modifications of the same technical idea.

What is claimed is:

1. An image heating apparatus, comprising:

a heater;

a heating roller heated by said heater;

a back-up roller for forming a nip for nipping and conveying a recording material by cooperating with said heating roller; and power supply control means for controlling a power supply to said heater so that a temperature of said heating roller may be maintained at a standby temperature during a standby period and at an image heating temperature during an image heating period, wherein when a temperature of said heating roller reaches a predetermined temperature lower than the standby temperature, said power supply control means cuts off the power supply to said heater, and then said heating roller and said back-up roller stop their rotation before the temperature of said heating roller reaches the standby temperature.

2. An image heating apparatus according to claim 1, wherein stopping the rotation of said heating roller and back-up roller is effected a predetermined time after the power supply is cut off.

3. An image heating apparatus according to claim 2, wherein the predetermined time is set in conformity with the temperature of said heating roller after the completion of the image heating period.

4. An image heating apparatus comprising:

a heater;

a heating roller heated by said heater;

a back-up roller for forming a nip for nipping and conveying a recording material by cooperating with said heating roller; and power supply control means for controlling a power supply to said heater so that a temperature of said heating roller may be maintained at a standby temperature during a standby period and at an image heating temperature during an image heating period, wherein while a temperature of said heating roller is changing from the image heating temperature to the standby temperature after an image heating operation is finished, said power supply control means cuts off the power supply to said heater, and then said heating roller and said back-up roller stop their rotation before the temperature of said heating roller reaches the standby temperature.

5. An image heating apparatus according to claim 4, wherein stopping the rotation of said heating roller and back-up roller is effected a predetermined time after the power supply is cut off.

6. An image heating apparatus according to claim 5, wherein the predetermined time is set in conformity with the temperature of said heating roller after the completion of the image heating period.

7. An image heating apparatus, comprising:

a heater;

a heating roller heated by said heater;

a back-up roller for forming a nip for nipping and conveying a recording material by cooperating with said heating roller; and power supply control means for controlling a power supply to said heater so that a temperature of said heating roller may be maintained at a standby temperature during a standby period and at an image heating temperature during an image heating period, wherein a rotation of said heating roller and said back-up roller is controlled in accordance with a temperature of said back-up roller during the standby period.

8. An image heating apparatus according to claim 7, wherein during the standby period, when the temperature of said back-up roller drops lower than a first predetermined temperature, said heating roller and said back-up roller starts to rotate, and when the temperature of said back-up roller rises to a second predetermined temperature higher than the first predetermined temperature, said power supply means cuts off the power supply to said heater, and then, after a predetermined time period has passed, said heating roller and said back-up roller stops their rotation.

* * * * *

UNITED STATES PATENT AND TRADEMARK OFFICE

CERTIFICATE OF CORRECTION

PATENT NO. : 6,185,388 B1
DATED : February 6, 2001
INVENTOR(S) : Naoyuki Yamamoto It is certified that error appears in the above-identified patent and that said Letters Patent is hereby corrected as shown below:

Drawings,
Figure 3, "PUT FUL OF HALOGEN HEATER ON" should read -- PUT HALOGEN HEATER ON --.
Figure 4, "PUT FUL OF HALOGEN HEATER ON" should read -- PUT HALOGEN HEATER ON --.
Figure 7, "PAIN OF ROLLER" should read -- PAIR OF ROLLERS --.

Column 4,
Line 63, "the both" should read -- both the --.

Signed and Sealed this

Sixth Day of November, 2001

*Attest:*

Nicholas P. Godici

*Attesting Officer*

NICHOLAS P. GODICI
*Acting Director of the United States Patent and Trademark Office*